US007168990B2

(12) United States Patent
Suzuki et al.

(10) Patent No.: US 7,168,990 B2
(45) Date of Patent: Jan. 30, 2007

(54) FEMALE SIDE CONNECTOR FOR HIGH CURRENT

(75) Inventors: Katsumi Suzuki, Tokyo (JP); Yuji Nakamura, Tokyo (JP); Kenji Ichihara, Kawasaki (JP)

(73) Assignee: Yamaichi Electronics Co., Ltd., Toykyo (JP)

( * ) Notice: Subject to any disclaimer, the term of this patent is extended or adjusted under 35 U.S.C. 154(b) by 0 days.

(21) Appl. No.: 11/097,215

(22) Filed: Apr. 4, 2005

(65) Prior Publication Data

US 2005/0221690 A1 Oct. 6, 2005

(30) Foreign Application Priority Data

Apr. 5, 2004 (JP) ..... 2004-111540

(51) Int. Cl.
*H01R 24/00* (2006.01)

(52) U.S. Cl. ..... 439/636; 439/637; 439/856; 439/857; 439/267; 439/268

(58) Field of Classification Search ..... 439/267, 439/857, 637, 843, 636, 736
See application file for complete search history.

(56) References Cited

U.S. PATENT DOCUMENTS 5,052,953 A * 10/1991 Weber ..... 439/857
5,162,002 A * 11/1992 Regnier ..... 439/637
5,897,394 A * 4/1999 Adachi ..... 439/496
6,036,506 A * 3/2000 Korsunsky ..... 439/79
6,102,754 A * 8/2000 Capper et al. ..... 439/857
6,220,868 B1 * 4/2001 Pei et al. ..... 439/60

(Continued)

FOREIGN PATENT DOCUMENTS

| | | |
|---|---|---|
| JP | 60-181870 | 12/1985 |
| JP | 3-6448 | 1/1991 |
| JP | 7-073922 | 3/1995 |
| JP | 2002-56910 | 2/2002 |

OTHER PUBLICATIONS

Solton, Home Page of Solton Co., Ltd., www.solton.co.jp, Part 1-4, 6 and 7, 11 pages, (Jan. 23, 2004).

*Primary Examiner*—Tulsidas C. Patel
*Assistant Examiner*—Harshad C Patel
(74) *Attorney, Agent, or Firm*—Finnegan, Henderson, Farabow, Garrett & Dunner LLP

(57) ABSTRACT

A female side connector for high current includes at least one contact unit including a contact, a contact support section, and a connection terminal: and a connector housing for placing the contact support section. The contact is provided by superposing a plurality of L-shaped and thin plate-like contact elements in the plate thickness direction, the contact element has a rectangular base end and a pair of elastically deformable arms that extend from the upper part of the rectangular base end and that respectively have opposing contact points at the neighborhood of the tip end. The contact support section supports the contact. The connection terminal is integrated with the contact support section and electrically contacts with outside. The contact is provided such that at least two or more contact elements having respectively different distances from the arm tip end to the contact point are superposed in the plate thickness direction.

7 Claims, 19 Drawing Sheets

U.S. PATENT DOCUMENTS 6,254,435 B1 * 7/2001 Cheong et al. ..... 439/637
6,394,823 B1 * 5/2002 Dunham et al. ..... 439/108
6,508,656 B2 * 1/2003 Chevassus-More et al. . 439/212
6,585,544 B2 * 7/2003 Furutani ..... 439/852
6,645,012 B2 11/2003 Ito et al.
6,921,301 B2 * 7/2005 Conrad ..... 439/853

* cited by examiner

FEMALE SIDE CONNECTOR FOR HIGH CURRENT

This application claims priority from Japanese Patent Application No. 2004-111540 filed Apr. 5, 2004, which is incorporated hereinto by reference.

BACKGROUND OF THE INVENTION

1. Field of the Invention

The present invention relates to a female side connector for high current used for an operation such as an IC package test. More particularly, the present invention relates to a female side connector for high current to which or from which a conductor member or a card edge pad as a male side connector can be inserted or disengaged without requiring a large force.

2. Description of the Related Art

In a reliability test for an IC package or the like, a number of sockets respectively mounting thereon a number of IC packages are provided on a test board to be subjected to the test. For example, as shown in FIG. 19, in order to connect a burn-in test board, on which a number of sockets respectively sockets mounting thereon a number of IC packages (not shown) are arranged, to an external power source, the card edge 2 as a male side connector having concentrated external terminals is provided at the side of the test board 1. This card edge 2 is connected to an external power source via the female side connector 3. Even if a small amount of current is flowed in a IC package itself to be tested, the entire test board requires a current having an amount multiplied by the number of IC packages to be mounted, thus allowing a relatively high current to pass through the connector 3.

Such a female side connector, through which a high current flows, has been conventionally known, as disclosed in Japanese Patent Application Laid-Open No. 2002-056910, a microfilm of Japanese Utility Model Application No. 59-69384(1984) (Japanese Utility Model Application Laid-Open No. 60-181870(1985)), and Japanese Utility Model Publication No. 3006448, for example. In such a female side connector, it has been known to be able to pass a larger current therethrough if the conductor part has a larger cross section and the width or the number of electric contact parts is increased, in view of the conductor resistance and the contact resistance.

Recently, with an increased number of IC packages mounted on a test board via the IC socket and a larger size and a more complicated structure of the IC package itself, a test board has been required to have therein a larger current (e.g., current of 200 to 2000 amperes).

In order to allow such a high current to flow, the female connectors disclosed in the above Patent References have a limitation. For example, in the female side connector 1 disclosed in Patent Reference No. 2002-056910, considering the conductor resistance and the contact resistance as described above, the width, height, and length of the female side connector inevitably become larger and also the manufacture of the connector becomes more difficult, thus increasing the manufacturing cost. Since the elastic force of contacts in the female side connector becomes too strong, the female side connector also requires a card edge as a male connector to be engaged or disengaged with a large force. As a result, the card edge is difficult to be engaged or disengaged, the card edge is damaged, and the pad part of the card edge may be broken in some cases.

SUMMARY OF THE INVENTION

In view of the above problems, it is an objective of the present invention to provide a female side connector for high current that can be electrically connected to a male side connector easily, that can allow a high current to pass therethrough in spite of the compact structure, and that can be manufactured easily and with a lower cost.

In order to achieve the above objective, the female side connector for high current according to the present invention comprises: at least one contact unit including a contact, a contact support section, and a connection terminal: and a connector housing for placing the contact and the contact support section. The contact is provided by superposing a plurality of thin plate-like contact elements in the plate thickness direction, the contact element has a rectangular base end and a pair of elastically deformable arms that extend from the rectangular base end parallel to each other and that have opposing contact points at the neighborhood of the tip end of each arm. The contact support section supports the contact. The connection terminal is integrated with the contact support section and electrically contacts with outside. In the female side connector for high current according to the present invention, the contact is provided such that at least two or more contact elements having respectively different distances from the arm tip end to the contact point are superposed in the plate thickness direction.

Further alternative female side connector for high current according to the present invention is a female side connector for high current comprises: at least one contact unit including a contact, a contact support section, and a connection terminal: and a connector housing for placing the contact and the contact support section. The contact is provided by superposing a plurality of thin plate-like contact elements in the plate thickness direction, the contact element has a rectangular base end and a pair of elastically deformable arms that extend from the rectangular base end parallel to each other and that have opposing contact points at the neighborhood of the tip end of each arm. The contact support section supports the contact. The connection terminal is integrated with the contact support section and electrically contacts with outside. In this another female side connector for high current according to the present invention, the contact element further includes, at the tip end of each arm, a pair of driving arms that can open the contact points in a forced manner and that are orthogonal to the arm.

In this female side connector for high current, the female side connector for high current more preferably further includes a pair of latches that are engaged with the driving arm to open the contact points in a forced manner.

Furthermore, another female side connector for high current according to the present invention is a female side connector for high current comprises: at least one contact unit including a contact, a contact support section, and a connection terminal: and a connector housing for placing the contact and the contact support section. The contact is provided by superposing a plurality of thin plate-like contact elements in the plate thickness direction, the contact element has a rectangular base end and a pair of elastically deformable arms that extend from the rectangular base end parallel to each other and that have opposing contact points at the neighborhood of the tip end of each arm. The contact support section supports the contact. The connection terminal is integrated with the contact support section and electrically contacts with outside. In this further alternative female side connector for high current according to the present invention, the female side connector for high current further includes a thin plate-like contact element including a rectangular base end and a pair of arms substantially having no contact point that extend from the rectangular base end parallel to each other, and the contact is provided by superposing, in the plate thickness direction, the contact element substantially having no contact point between the contact elements having the contact points.

In this female side connector for high current, the thin plate-like contact element having the pair of elastically deformable arms that have opposing contact points at the neighborhood of the tip end of each arm more preferably include a pair of operation levers that can open the contact points in a forced manner. The operation lever is provided at the tip end of each arm and is provided to be orthogonal to the arm.

The contact of the female side connector for high current according to the present invention is formed by superposing a plurality of contact elements having different positions of contact points in the plate thickness direction. The contact points of the respective contact elements are dislocated. Therefore, when the card edge as a male side contact is inserted into the female side connector for high current according to the present invention, the card edge can be inserted with a small amount of force without causing the simultaneous deformation of the arms of all contact elements.

The contact element further includes the driving arm or the operation lever that can open the contact points in a forced manner so that the driving arm or the operation lever is provided at the tip end of the arm and is orthogonal to the arm. This eliminates the need for using the card edge to displace the contact points, thus the insertion of the card edge can be further simplified while perfectly eliminating the insertion resistance. Furthermore, the driving arm can be engaged with the latch, thus allowing, in an easier manner, the contact point to be dislocated from the exterior.

The contact is formed by superposing thin plate-like contact elements in the plate thickness direction and thus can be manufactured easily with a low cost.

Furthermore, the two neighboring contacts are arranged symmetrically and in a zigzag manner and thus even the connector having therein an increased number of contacts can be provided in a compact manner.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, embodiments according to the present invention will be described.

Embodiment 1

Figure 1:
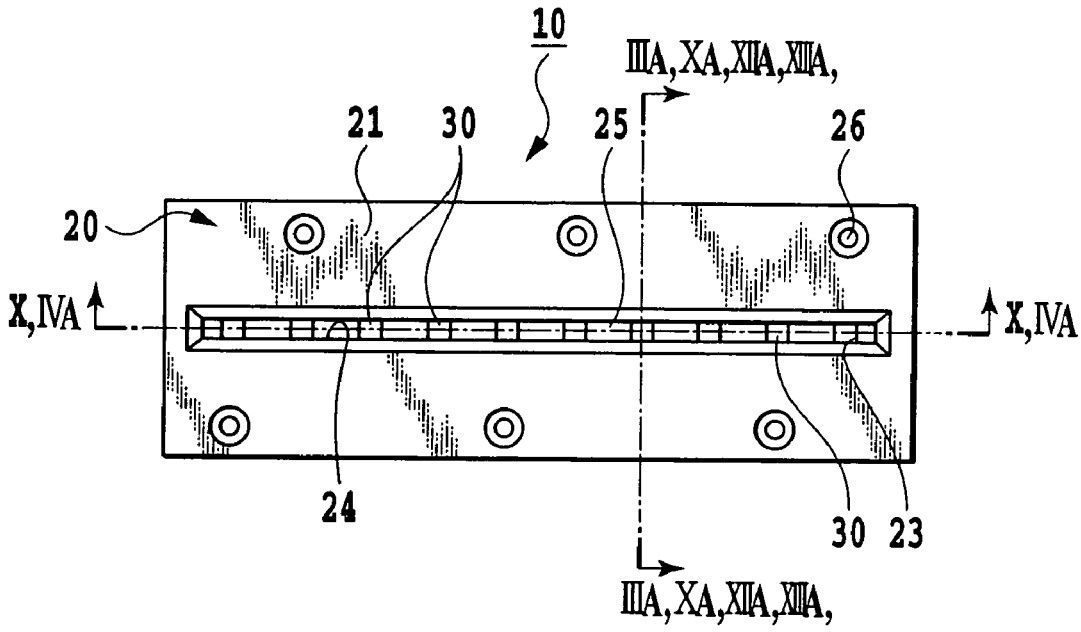
FIG. 1 is a schematic front view illustrating Embodiment 1 of a female side connector according to the present invention.
Figure 2:
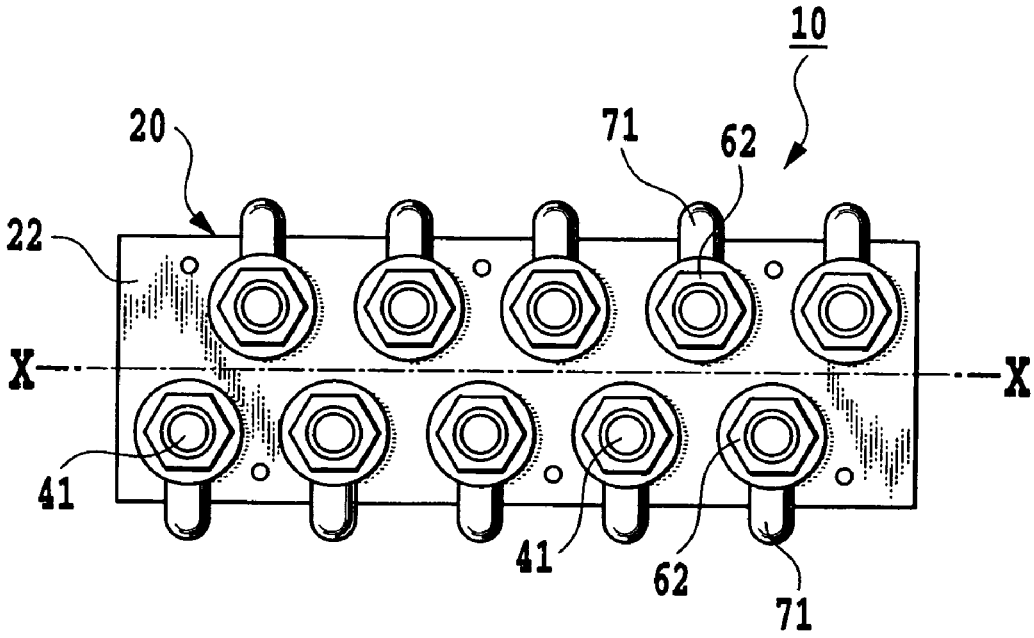
FIG. 2 is a schematic back view illustrating the connector of FIG. 1.
Figure 6A:
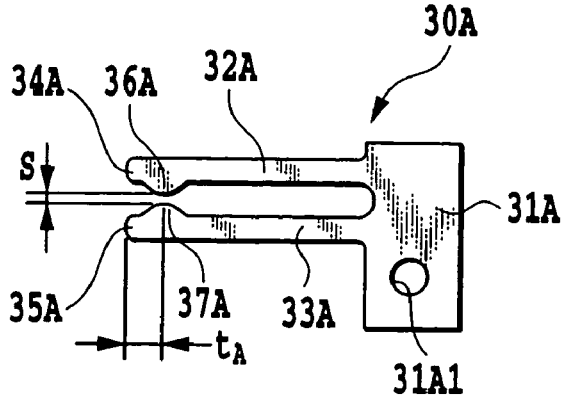
FIG. 6A shows the first contact element constituting an electric connection section (i.e., contact) of a contact unit of the female side connector according to Embodiment 1.
Figure 6B:
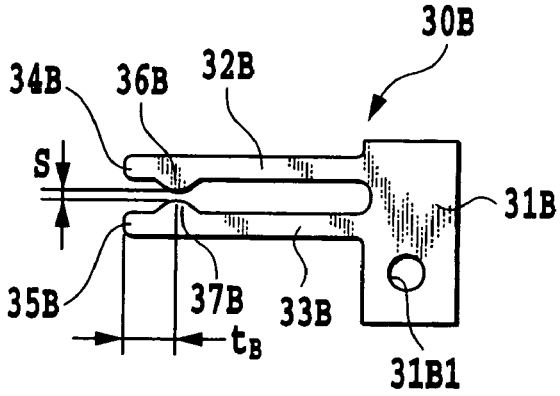
FIG. 6B shows the second contact element that is different from the first contact element and that constitutes an electric connection section (i.e., contact) of a contact unit of the female side connector according to Embodiment 1.
Figure 6C:
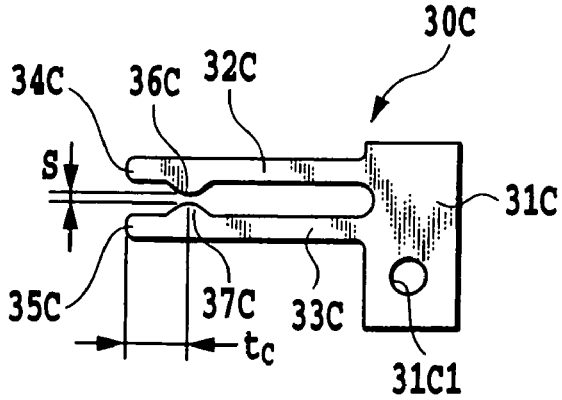
FIG. 6C shows the third contact element that is different from the first contact element and the second contact element and that constitutes an electric connection section (i.e., contact) of a contact unit of the female side connector according to Embodiment 1.
Figure 7A:
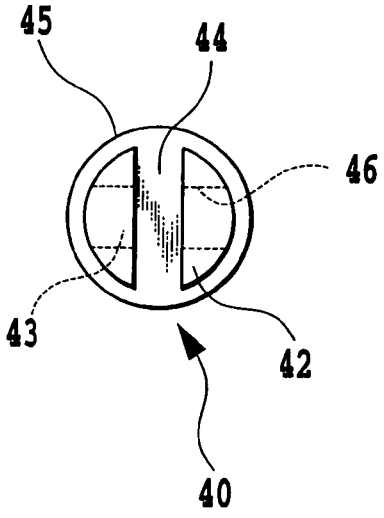
FIG. 7A is a front view of a sleeve constituting the contact unit of the female side connector according to Embodiment 1.
Figure 7B:
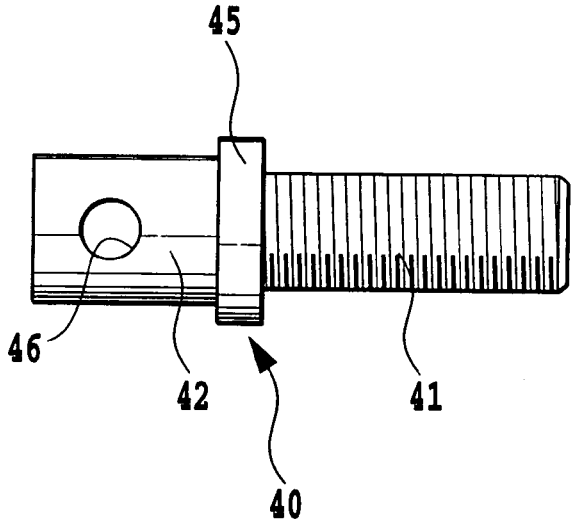
FIG. 7B is a side view illustrating the sleeve shown in FIG. 7A.
Figure 8:
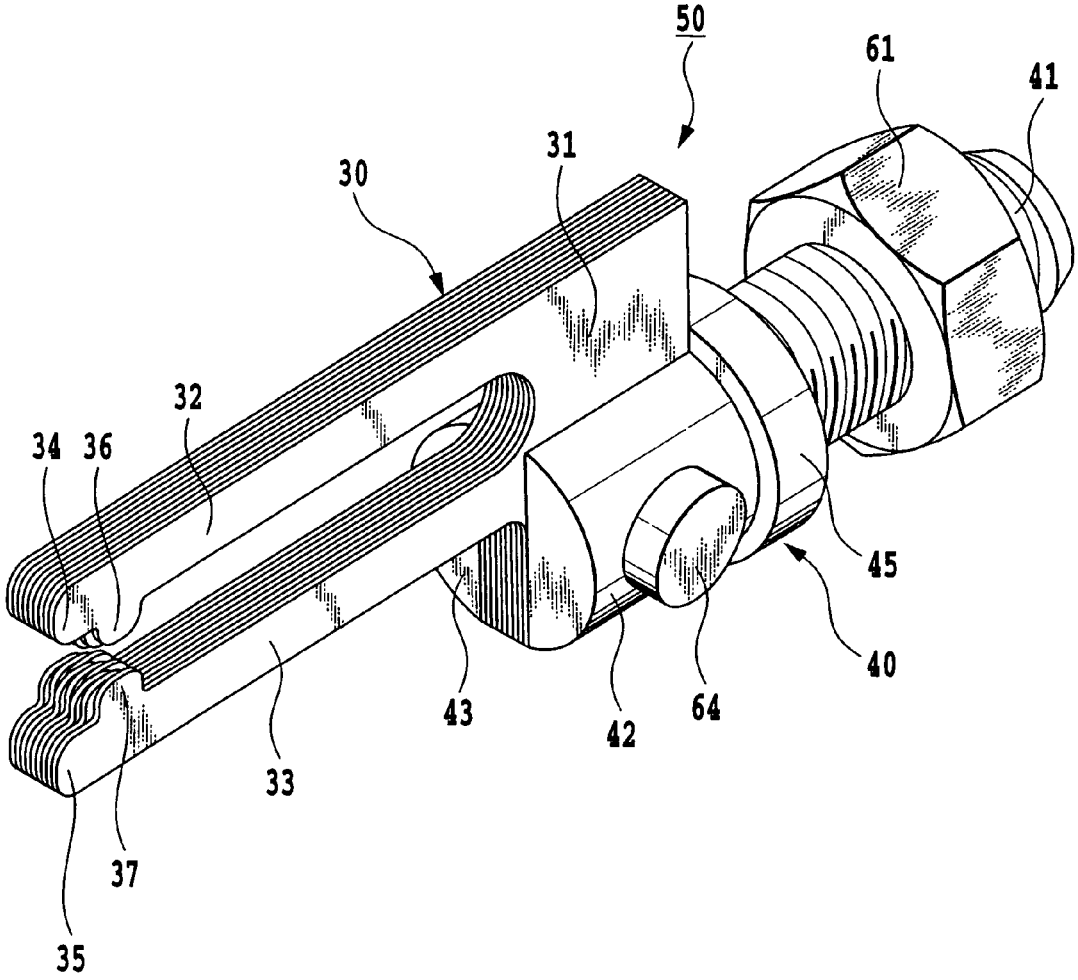
FIG. 8 is a perspective view illustrating the contact unit in which the first to third contact elements shown in FIGS. 6A to 6C and the sleeves shown in FIGS. 7A and 7B are assembled.

FIGS. 1 to 8 illustrate Embodiment 1 according to the present invention. FIG. 1 is a schematic front view illustrating a female side connector according to the present invention. FIG. 2 is a schematic back view illustrating the connector of FIG. 1. FIG. 3A is a schematic cross sectional view taken at the line IIIA—IIIA of the connector of FIG. 1 when a male side connector is not inserted. FIG. 3B is a partially enlarged cross sectional view as in FIG. 3A when a card edge pad as a male side connector is inserted. FIGS. 4A and 4B illustrate a front housing constituting the housing of the connector in this embodiment. FIG. 4A is a schematic cross sectional view along the center axis line IVA—IVA of FIG. 1. FIG. 4B is a schematic cross sectional view taken at the line IVB—IVB of FIG. 4A. FIG. 5A and FIG. 5B also show a rear housing constituting the housing. FIG. 5A is the front view and FIG. 5B is a schematic cross sectional view of the rear housing at the line VB—VB of FIG. 5A. FIGS. 6A to 6C show a contact element constituting an electric connection section (i.e., contact) of a contact unit of the female side connector according to the present invention. FIGS. 6A to 6C show three different types of first to third contact elements, respectively. FIGS. 7A and 7B show a sleeve constituting the contact unit. FIG. 8 is a perspective view illustrating the contact unit in which the contact elements of FIGS. 6A to 6C and the sleeve of FIGS. 7A and 7B are assembled.

The female side connector 10 for high current according to this embodiment (hereinafter also simply referred to as "connector") includes the connector housing 20. The connector housing 20 includes, in the internal space thereof, a plurality of contact units 50 arranged in parallel. The contact unit 50 includes the contact 30 and the sleeve 40 for supporting the contact 30. In this embodiment, as shown in FIGS. 1 and 2, ten contact units 50 are arranged in the connector housing 20 and the connection terminals 41 of the contact unit 50 are arranged in a staggered manner.

Figure 3A:
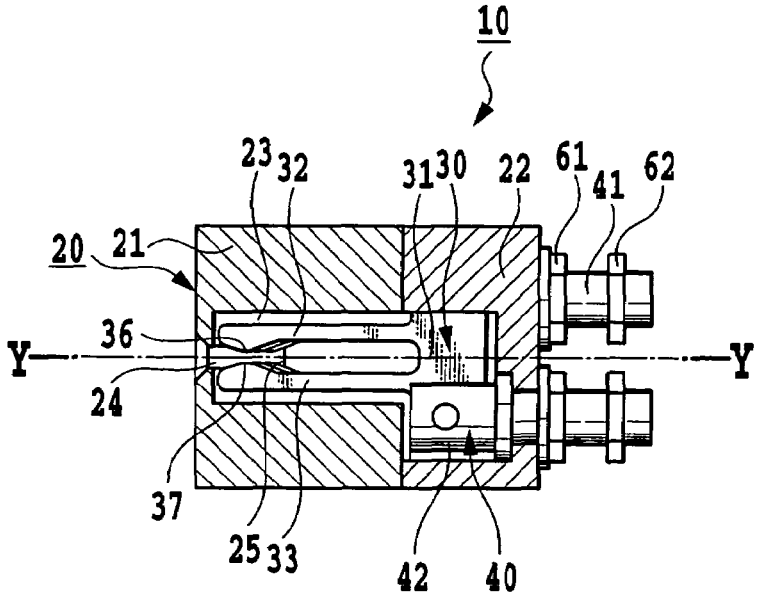
FIG. 3A is a schematic cross sectional view taken at the line IIIA—IIIA of the connector of FIG. 1 and is an enlarged cross-sectional of the main part in which a male side connector is not inserted.

The connector housing 20 has a substantially cuboid-like shape and is made of an electrically insulating synthetic resin (e.g., polyimide) for example and includes, as shown in FIG. 3A, the front housing 21 and the rear housing 22.

Figure 3B:
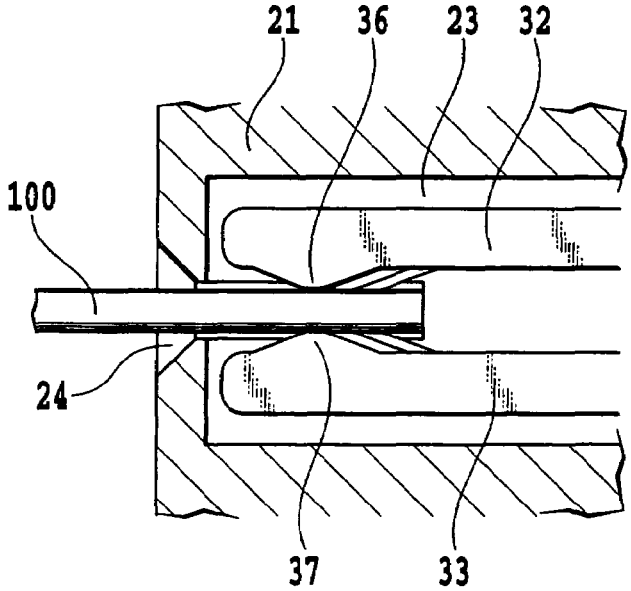
FIG. 3B is a schematic cross sectional view taken at the line IIIA—IIIA of the connector of FIG. 1 as in FIG. 3A and is an enlarged cross-sectional of the main part in which a card edge pad as a male side connector is inserted.
Figure 4A:
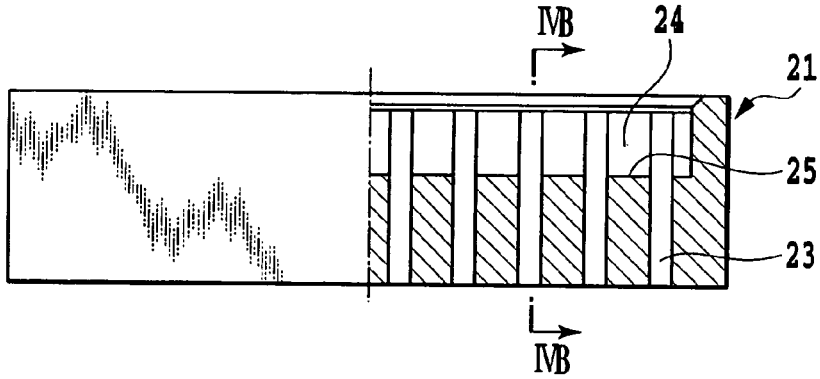
FIG. 4A is a schematic cross sectional view along the center axis line IVA—IVA of FIG. 1 that illustrates a front housing constituting a connector housing of a connector in Embodiment 1.
Figure 4B:
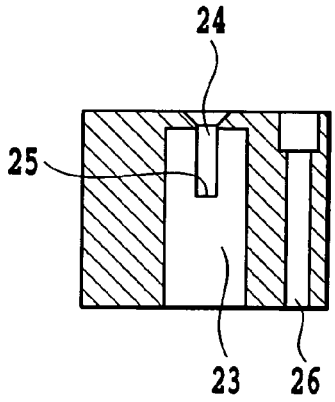
FIG. 4B is a schematic cross sectional view of the front housing taken at the line IVB—IVB of FIG. 4A.

As shown in FIGS. 4A and 4B, the front housing 21 includes longitudinal rectangular tube-like spaces 23 for respectively placing pairs of arms 32 and 33 of a plurality of contacts 30 (ten in this embodiment) described later. The rectangular tube-like space 23 is opened in the rearward direction (in the lower direction in FIG. 4B). The front housing 21 has, at the front face side, the opening space 24 along the longitudinal axis (X—X of FIG. 1) to which the card edge 100 (see FIG. 3B) as a male side connector is inserted. The opening space 24 is communicated with the rectangular tube-like space 23. The opening space 24 extends to be orthogonal to the longitudinal rectangular tube-like space 23 for placing the contact 30. Thus, the opening space 24 has a cross sectional shape as shown in FIG. 1 that has a flat rectangular shape that is similar to the outline of the cross sectional shape of the card edge 100. The opening space 24 is opened in a tapered manner in the frontward direction so as to guide the insertion of the card edge 100. The opening space 24 has a depth that is determined so that, when the card edge 100 is inserted to the opening space 24 to be abutted with the inner wall 25 to stop, the pad of the card edge 100 can contact with the corresponding contact point 36 and 37 of the contact 30. At appropriate upper and lower positions of the front housing 21 (see FIG. 1), the attachment hole 26 for integrally coupling with the rear housing 22 is provided so as to penetrate the front housing 21 in the front-and-rear direction (in the up-and-down direction in FIG. 4B).

Figure 5A:
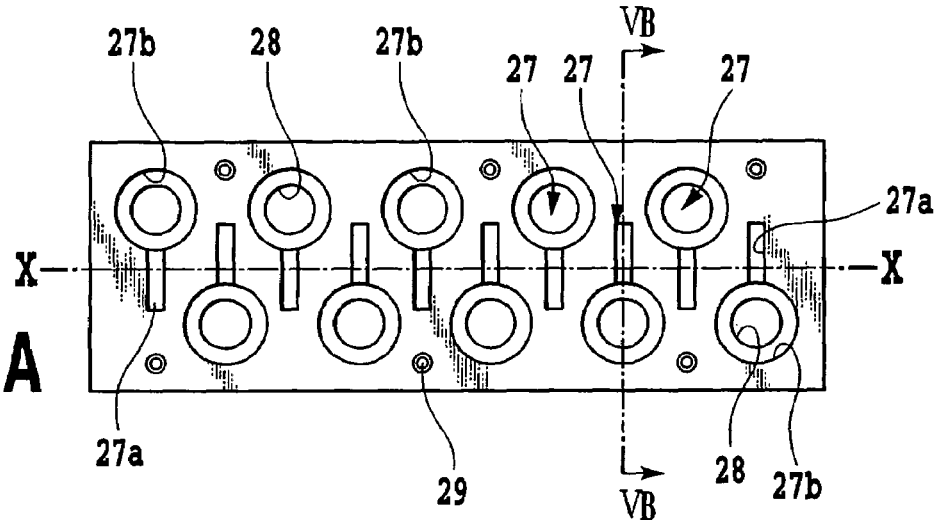
FIG. 5A is a front view of a rear housing constituting a connector housing of the connector in Embodiment 1.
Figure 5B:
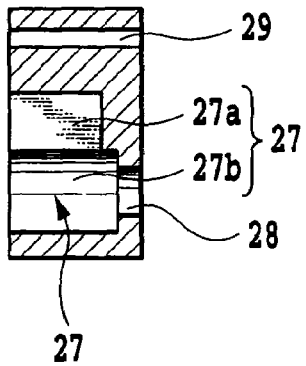
FIG. 5B is a schematic cross sectional view of the rear housing at the line VB—VB of FIG. 5A.

As shown in FIGS. 5A and 5B, in the rear housing 22, a plurality of spaces 27 are formed in a zigzag manner so that two neighboring spaces 27, 27 are symmetrically formed to sandwich the longitudinal axis X—X. The plurality of spaces 27 respectively place therein a part of the contact unit 50 including the rectangular base ends 31 of a plurality of contacts 30 and the contact support section 42 of the sleeve 40. These spaces 27 are all opened in the frontward direction (leftward direction in FIG. 5B). More particularly, each space 27 includes, as shown in FIG. 5A, the substantially rectangular tube-like space 27*a* and the substantially cylindrical space 27*b* communicated with the rectangular tube-like space 27*a*. The rectangular tube-like space 27*a* corresponds to a plurality of rectangular tube-like spaces 23 of the front housing 21. The rectangular tube-like space 27*a* places therein the upper part of the rectangular base end 31 of the contact 30. As clearly shown in FIG. 5A, the cylindrical space 27*b* is positioned at the upper or lower part of the rectangular tube-like space 27*a* so that two neighboring spaces 27 are symmetrical to sandwich the longitudinal axis X—X. By arranging the two neighboring spaces 27, 27 in a zigzag manner to sandwich the longitudinal axis X—X as described above, a great number of contact units can be arranged in the longitudinal direction, thus allowing the connector housing 20 to have a compact shape. The cylindrical space 27*b* places therein the contact support section 42 of the sleeve 40. In this embodiment, the rectangular tube-like space 27*a* has a height and a width that are the same as those of the rectangular tube-like space 23 of the front housing 21, respectively. It is noted that rectangular tube-like space 27*a* are not always required to have a height and a width that are the same as those of the rectangular tube-like space 23 of the front housing. The cylindrical space 27*b* has an inner diameter that is almost the same as the outer diameter of the flange 45 of the sleeve 40. The rear housing 22 has, at the rear face, the penetration holes 28 that are penetrated by the connection terminals 41 of the sleeve 40 and that are communicated to a plurality of spaces 27 (or cylindrical spaces 27*b* more particularly), respectively. The penetration hole 28 has an inner diameter that is larger than the outer diameter of the external terminal 41 of the sleeve 40 and that is smaller than the outer diameter of the flange 45. At the corresponding position of the attachment hole 26 of the front housing 21 in the up and down direction of the rear housing 22, there is provided the attachment hole 29 that penetrates the rear housing 22 in the front-and-rear direction.

The front housing 21 and the rear housing 22 are integrated by the attachment tool (not shown) such as attachment bolt, washer, nut via the respective attachment holes 26 and 29 so that a plurality of rectangular tube-like spaces 23 are communicated with the corresponding plurality of rectangular tube-like spaces 27*a*, thus providing the connector housing 20. More particularly, in the front housing 21 and the rear housing 22, the one rectangular tube-like space 23 of the front housing 21 and corresponding one space 27 of the rear housing 22 are integrated as shown in FIG. 3A so that the space 23 and the space 27 (or one space 27*a* more particularly) share the same ceiling face and so that the next space 23 of the front housing 21 and the next space 27 (or next space 27*a* more particularly) share the same bottom face. As a result, the space 23 and the space 27 provide a space having a substantially L-like shape cross section that is similar to the cross sectional shape of the contact 3.

The contact 30 for providing the contact unit 50 in this embodiment is provided by superposing a plurality of contact elements 30A, 30B, and 30C in the plate thickness direction. The contact elements 30A, 30B, and 30C respectively shown in FIGS. 6A, 6B, and 6C respectively have a substantially L-like entire shape and are formed by pressing out a thin metal plate having the thickness of 0.15 to 0.25 mm. Thus, the contact 30 requires a low cost for the manufacture.

As shown in FIG. 6A, the first contact element 30A includes the rectangular base end 31A and a pair of upper arm 32A and lower arm 33A that extend to have a distance therebetween in the up-and-down direction from the side part of the upper part of the rectangular base end 31A. The rectangular base end 31A has, at the lower part, the attachment hole 31A1. As shown in FIG. 3A, the pair of upper arm 32A and lower arm 33A are designed so as to be parallel to the center axis line Y—Y of the housing 20 and to be symmetric to sandwich the axis line Y—Y (i.e., so as to be parallel to each other). The upper arm 32A and lower arm 33A are also provided so that they can be displaced respectively downward and upward in FIG. 6A, that is, so that they can be elastically deformed. The projection parts (hereinafter also referred to as "contact point") 36A and 37A as a contact point are respectively protruded from the lower edge of the upper arm 32A and the upper edge of the lower arm 33A so that the projection tip ends are opposed to each other at the position that is rearward by the distance $t_A$ from the respective tip ends 34A and 35A of the upper arm 32A and the lower arm 33A. The contact points 36A and 37A electrically contact with the pads of the card edge 100. As shown in the drawing, the projection tip ends of the contact points 36A and 37A are separated by the distance "s" that is smaller than the thickness of the pad of the card edge 100. This allows the contact points 36A and 37A to contact with the pad of the card edge 100 with a fixed contact pressure.

As shown in FIG. 6B, the second contact element 30B has the same structure as that of the first contact element 30A in which the second contact element 30B has the rectangular base end 31B and a pair of arms 32B and 33B that extend to have a distance therebetween in the up-and-down direction from the side part of the upper part of the rectangular base end 31B. The second contact element 30B has the same structure as that of the first contact element 30A except for that the projection parts (hereinafter also referred to as "contact point") 36B and 37B as a contact point provided in the pair of arms 32B and 33B are provided at different positions, that is, the distance $t_B$ from the respective tip ends 34B and 35B of the arms 32B and 33B to the contact points 36B and 37B is different.

As shown in FIG. 6C, the third contact element 30C has the same structure as those of the first and second contact elements 30A and 30B in which the third contact element 30C has the rectangular base end 31C and a pair of arms 32C and 33C that are extended from the side part of the upper part of the rectangular base end 31C to have a distance therebetween in the up-and-down direction. The third contact element 30C has the same structure as those of the first and second contact elements 30A and 30B except for that the projection parts (hereinafter also referred to as "contact point") 36C and 37C as a contact point provided in the pair of arms 32C and 33C are provided at different positions, that is, the distance $t_C$ from the respective tip ends 34C and 35C of the arms 32C and 33C to the contact points 36C and 37C is different.

In this embodiment, the respective contact points 36A, 36B, and 36C of the first to third contact elements 30A, 30B, and 30C have a relation of $t_A<t_B<t_C$. However, the present invention is not limited to this. The type of the contact element is also not limited to the three types as in this embodiment.

As described above, in this embodiment, the first to third contact elements 30A, 30B, and 30C that are different only in the position of the contact point are superposed in the plate thickness direction to provide the contact 30. By providing the contact 30 in this manner, when the card edge 100 as a male side contact is inserted as shown in FIG. 3B, the card edge 100 can be inserted without causing the simultaneous deformation of the arms of all of the contact elements since respective positions of contact points of contact elements are different. In this case, the same contact elements are more preferably superposed so as not to be adjacent to each other. In order to reduce the friction between the contact elements to provide the displacement of the contact elements in a smooth manner, for example, the base ends of neighboring contact elements may be provided therebetween with a conductive thin film, such as thin metal plate, as a spacer.

Next, with reference to FIGS. 7A and 7B, the sleeve 40 for constituting the contact unit 50 will be described.

The sleeve 40 is made of copper alloy such as brass and includes the connection terminal 41, the flange 45, and the contact support sections 42 and 43. The connection terminal 41 is connected to one end of a cable the other end of which is connected to an external power source or the like, for example. The outer periphery of the connection terminal 41 is screwed and the screw is screwed with the attachment nut 61 to cooperate with flange 45 to fix the contact unit 50 to the housing 20 and another nut 62 is screwed so that the nuts 61 and 62 sandwich the tongue of the cable terminal 71 (see FIG. 17A), thereby providing an electrical connection between the connection terminal 41 and the cable.

The contact support sections 42 and 43 are paired and have therebetween the engagement groove 44. The engagement groove 44 has a depth that is almost the same as the width of the rectangular base end 31A of the contact element 30A. The contact support sections 42 and 43 both have profiles having circular arc-like cross sections. When these circular arcs are extended outwardly, they shape one circle. This circle has a diameter that may be equal to or smaller than the outer diameter of the flange 45. The pair of contact support sections 42 and 43 have the attachment holes 46 that correspond to the attachment holes 31A1, 31B1, and 31C1 of the contact elements 30A, 30B, and 30C. The cross sectional shape of the contact support sections 42 and 43 is not limited to the circular arc one as in this embodiment and also may be the rectangular one.

The engagement groove 44 is engaged with the contact 30 consisting of the first to third contact elements 30A, 30B, and 30C. The first to third contact element 30A, 30B, and 30C respectively have the attachment holes 31A1, 31B1, and 31C1 and the contact support sections 42 and 43 have the attachment holes 46. By using the attachment means 64 such as screw, rivet and the like via attachment holes 31A1, 31B1, and 31C1 and the attachment holes 46 or by caulking the contact support sections 42 and 43, the contact 30 is fixed to the sleeve 40 (between the pair of contact support sections 42 and 43 more particularly). In this embodiment, nine contact elements are superposed in the plate thickness direction to provide the contact 30. Specifically, in this embodiment, the total of nine contact elements, i.e., three first contact elements 30A, three second contact elements 30B, and three third contact elements 30C, are superposed in the plate thickness direction so that the same contact elements are not adjacent to each other (see FIG. 8). However, the number of the contact elements is not limited to nine in this embodiment. For example, the number of the contact elements is appropriately determined depending on the amount of current to flow (100 amperes in this embodiment).

In the connector 10 in this embodiment, nine contact elements are firstly superposed in the plate thickness direction so that the same contact elements are not adjacent to each other to provide the contact 30. Next, the contact 30 is engaged with the engagement groove 44 between the contact support sections 42 and 43 of the sleeve 40 so that the contact 30 is fixed by a screw or the like, thereby providing the contact unit 50 as shown in FIG. 8. Next, this contact unit 50 is incorporated in the space 27 of the rear housing 22 and the attachment means 60 such as nut is screwed into the connection terminal 41, thereby fixing the contact unit 50 to the rear housing 22. Next, the pair of arms 32 and 33 of the contact 30 is inserted to the corresponding rectangular tube-like space 23 of the front housing 21. Thereafter, the attachment means 23 is used to fix the front housing 21 and the rear housing 22 to be integrated. In this way, the female side connector 10 for high current according to Embodiment 1 of the present invention can be manufactured in an easy manner. In order to connect the connector 10 to the card edge 100 as a male side connector, the card edge 100 may be only pushed into the opening space 24 of the connector 10 until the card edge 100 abuts with the inner wall 25 to stop. In this case, the card edge 100 requires a small force for pushing the card edge 100 as described above, thus allowing the card edge 100 to be inserted in an easy manner. The contact 3 also can be deformed in a smooth manner, thus preventing the pad of the card edge 100 from being damaged.

Embodiment 2

Figure 9A:
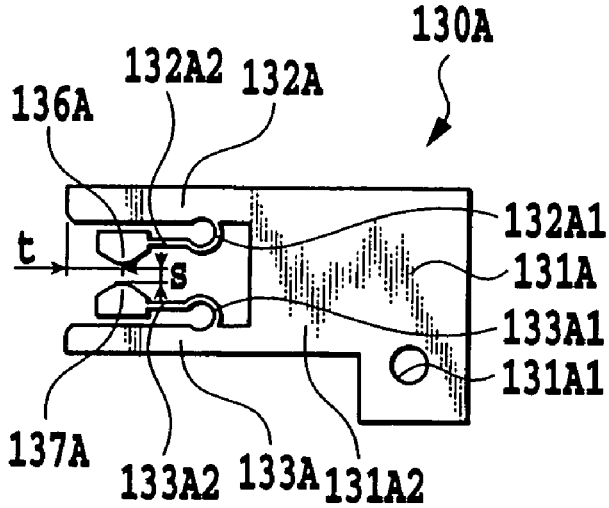
FIG. 9A illustrates another combination of contact elements constituting the contact according to Embodiment 2 of the present invention and shows the fourth contact element.
Figure 9B:
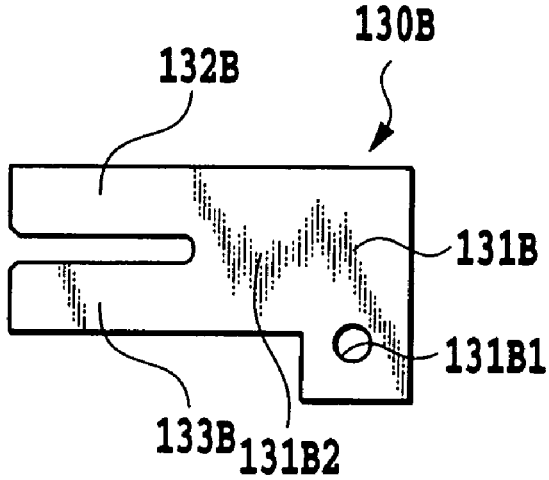
FIG. 9B illustrates another combination of contact elements constituting the contact according to Embodiment 2 of the present invention and shows the fifth contact element.
Figure 10A:
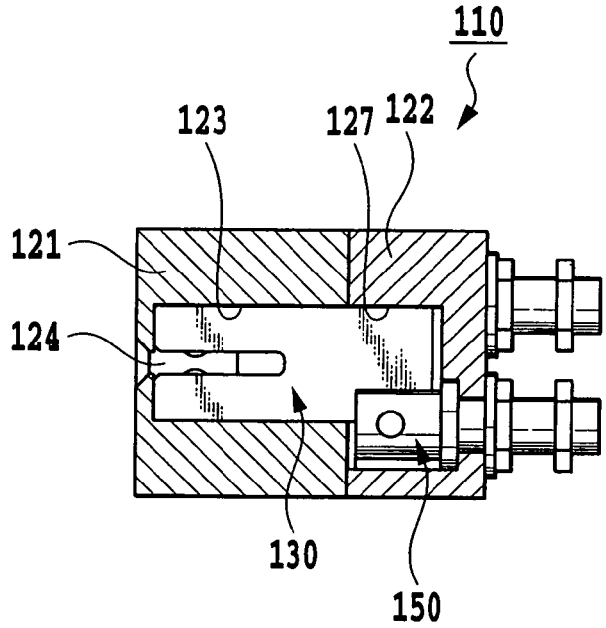
FIG. 10A shows the connector according to Embodiment 2 using the fourth and fifth contact elements shown in FIGS. 9A and 9B and is a schematic cross sectional view as in FIG. 3A that is taken at the line XA—XA of the connector of FIG. 1 in which the male side connector is not inserted.
Figure 10B:
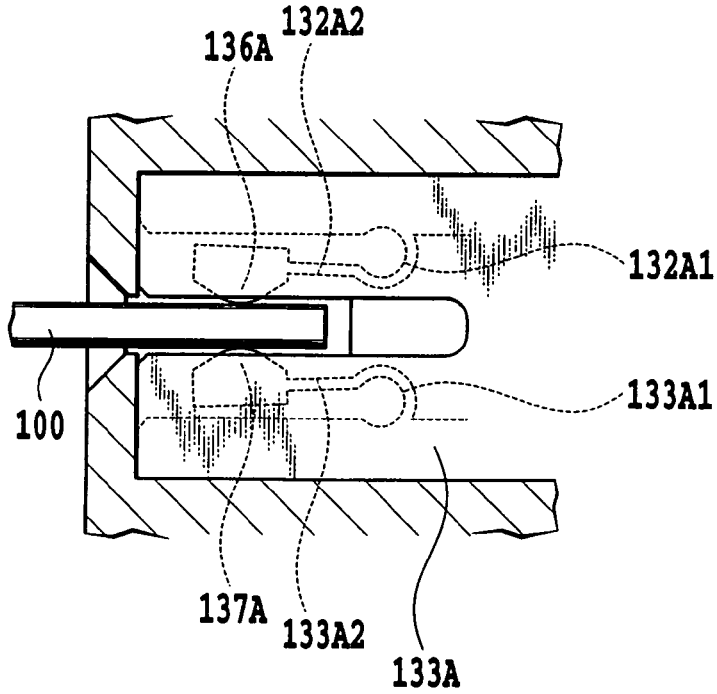
FIG. 10B is an enlarged cross-sectional view of the main part illustrating the connector shown in FIG. 10A in which the card edge as a male side connector is inserted.

Next, with reference to FIGS. 9A and 9B and FIGS. 10A and 10B, Embodiment 2 according to the present invention will be described. FIG. 9A shows the fourth contact element in this embodiment. FIG. 9B shows the fifth contact element in this embodiment. FIG. 10A is a schematic cross sectional view along the line XA—XA of the connector of FIG. 1 in which the male side connector is not inserted. FIG. 10B is an enlarged cross-sectional view of the main part in which the male side connector is inserted.

Embodiment 2 is almost the same as Embodiment 1 except for that the contact elements for constituting the contact 130 are different. The components in Embodiment 2 that correspond to those of Embodiment 1 are denoted such that the reference numerals showing such components of Embodiment 2 are added with 100. In Embodiment 2, the fourth and fifth contact elements 130A and 130B respectively shown in FIGS. 9A and 9B are alternately superposed to provide the contact 130.

As shown in FIG. 9A, the fourth contact element 130A in this embodiment has a substantially L-like shape as in the contact element shown in Embodiment 1 and is pressed out of a thin metal plate. The fourth contact element 130A in this embodiment is different from that of Embodiment 1 in the following point. Specifically, the contact points 136A and 137A contacting with the male side connector of the fourth contact element 130A are respectively elastically attached to the arms 132A and 133A via the circular arc sections 132A1 and 133A1 respectively projecting from the pair of arms 132A and 133A and the straight sections 132A2 and 133A2 respectively continuing from the circular arc sections 132A1 and 133A1. This allows the contact points 136A and 137A to be displaced in a smooth manner. In this case, the arms 132A and 133A themselves need not have an elastic deformation as in Embodiment 1 and have only to support the contact points 136A and 137A. Thus, as shown in the drawing, the arms 132A and 133A may be projected from the intermediate section 131A2 extending from the rectangular base end 131A. The intermediate section 131A2 has the upper side that is on the same line with the upper side of the rectangular base end 131A and has the base that is at the upper part of the rectangular base end 131A to provide a step section. The existence of the intermediate section 131A2 as described above can increase the heat capacity of the contact element 130A, thus inhibiting the increased temperature by the flow of a high current.

In this embodiment, the projection tip ends opposed to each other of the contact points 136A and 137A are provided at positions that are rearward from the tip ends of the arms 132A and 133A by the distance "t" so that the projection tip ends are separated to have the distance "s" therebetween. The distance "t" may be the same as or be different from the distances $t_A$, $t_B$, and $t_C$ of the contact elements 30A, 30B, and 30C in Embodiment 1.

As shown in FIG. 9B, the fifth contact element 130B includes, as in the case of the contact element 30A, the intermediate section 131B2 extending from the rectangular base end 131B. From the intermediate section 131B2, the pair of arms 132B and 133B are projected. In this embodiment, the fifth contact element 130B is different from other contact elements in that the fifth contact element 130B does not have a projection section as a contact point. Specifically, the fifth contact element 130B is used only for allowing the current to flow from the contact points 136A and 137A of the fourth contact element 130A to be superposed. Thus, the arms 132B and 133B of the fifth contact element 130B may have therebetween a space that is slightly larger than the thickness of the card edge 100 as a male side connector. The fifth contact element 130B also may have a contact point.

In this embodiment, a number of two types of fourth and fifth contact elements 130A and 130B are superposed alternatively in the plate thickness direction to constitute the contact 130 and are assembled as the connector 110 by the same method as that of the Embodiment 1. In this embodiment, as shown in FIG. 10B, the contact points 136A and 137A of the fourth contact element 130A are elastically deformed easily and thus can be easily inserted with the card edge 100 as a male side connector. The existence of the arms 132B and 133B of the fifth contact element 130B superposed so as to sandwich the contact points 136A and 137A of the fourth contact element 130A prevents, when the card edge 100 is inserted to displace the contact points 136A and 137A, the contact points 136A and 137A from being twisted. This embodiment has a reduced number of the contact points of the contact 130 when compared to the case of Embodiment 1. However, this embodiment can have an increased number of contact points when compared to a conventional case. Furthermore, the arms 132B and 133B of the superposed fifth contact element 130B have an electrical contact with the contact points 136A and 137A of the contact element 130A, thus causing no trouble in flowing a high current.

Embodiment 3

Figure 11:
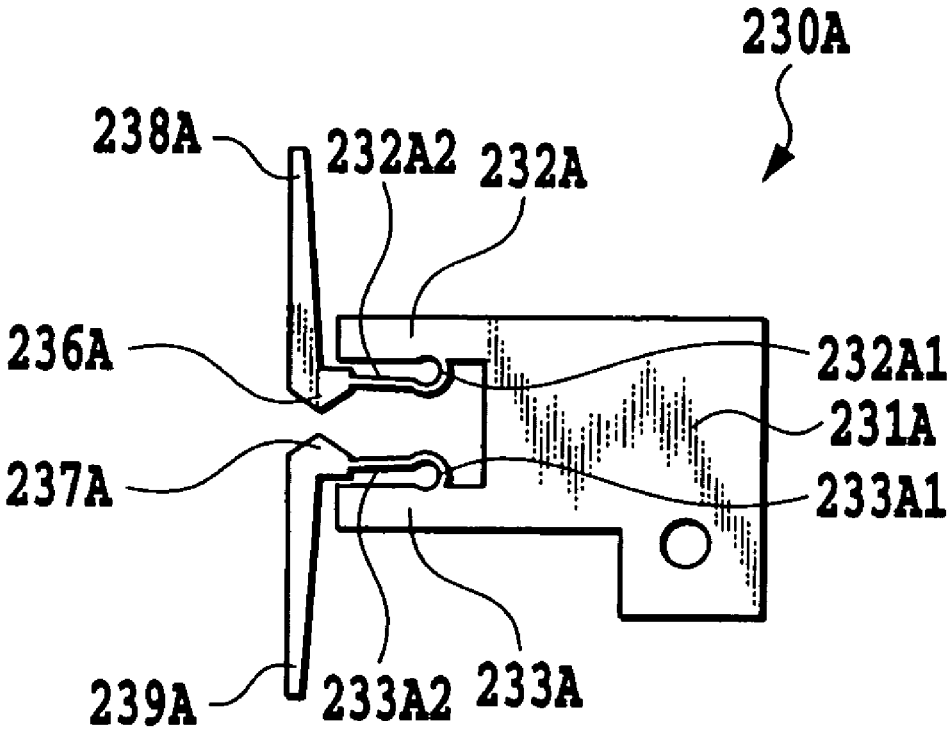
FIG. 11 shows the sixth contact element according to Embodiment 3 of the present invention.
Figure 12A:
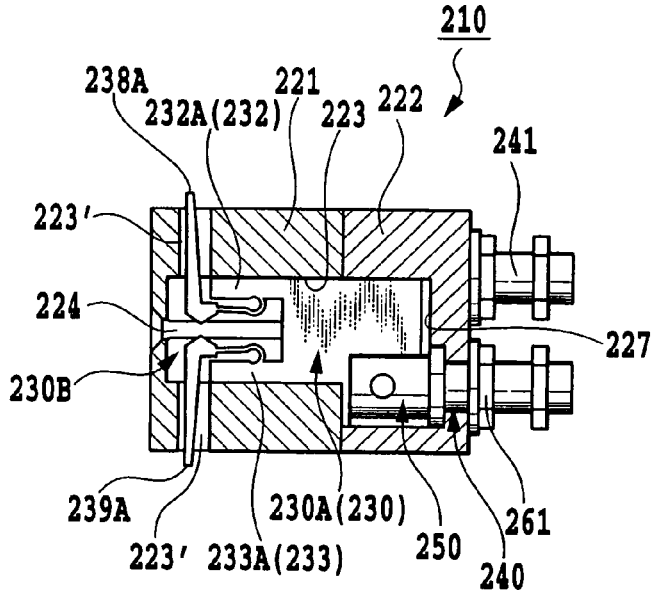
FIG. 12A shows the connector according to Embodiment 3 of the present invention and is a schematic cross sectional view taken at the line XIIA—XIIA of FIG. 1 as in FIG. 3A in which the male side connector is not inserted.
Figure 12B:
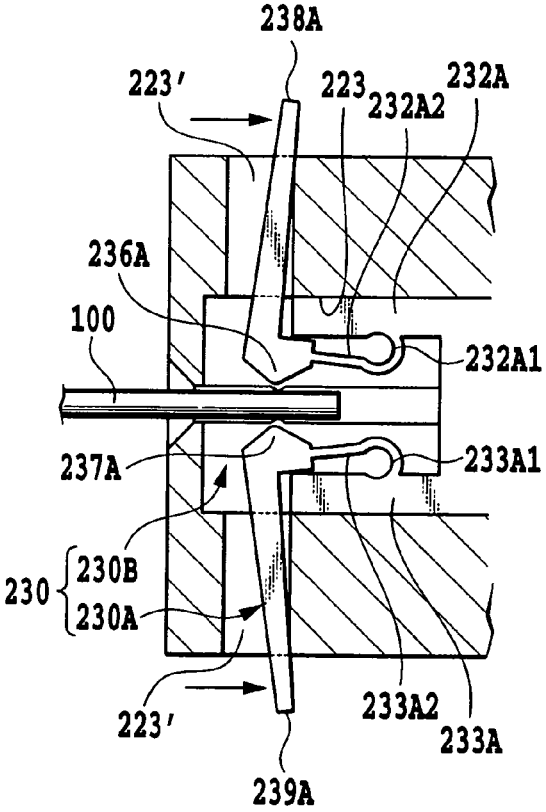
FIG. 12B is an enlarged cross-sectional view of the main part illustrating the connector shown in FIG. 12A and showing a process for inserting the male side connector.
Figure 12C:
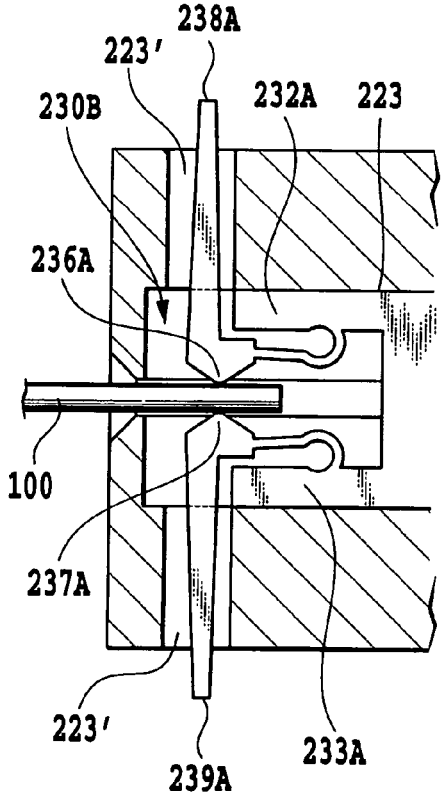
FIG. 12C is an enlarged cross-sectional view of the main part illustrating the connector shown in FIG. 12A in which the male side connector is inserted.

Next, with reference to FIG. 11 and FIGS. 12A, 12B, and 12C, Embodiment 3 according to the present invention will be described. FIG. 11 shows the sixth contact element. FIG. 12A is a schematic cross sectional view taken at the line XIIA—XIIA of the connector of FIG. 1 as in FIG. 3A in which a male side connector is not inserted. FIG. 12B is an enlarged cross-sectional view of the main part showing a process for inserting the male side connector. FIG. 12C is an enlarged cross-sectional view of the main part in which the male side connector is inserted.

The components in Embodiment 3 that correspond to those of Embodiment 1 are denoted such that the reference numerals showing such components of Embodiment 3 are added with 200.

Embodiment 3 is different somewhat from the above Embodiment 2. Specifically, in Embodiment 3, the sixth contact element 230A shown in FIG. 11 is alternatively superposed with the fifth contact element 230B, that has exactly the same structure as that of the fifth contact element 130 shown in FIG. 9B, to provide the contact 230.

The sixth contact element 230A in Embodiment 3 is also provided such that the contact points 236A and 237A contacting with the male side connector are elastically attached to the arms 232A and 233A via the circular arc sections 232A1 and 233A1 projecting from the pair of arms 232A and 233A and the straight sections 232A2 and 233A2 continuing from the circular arc sections 232A1 and 233A1, respectively. This structure is exactly the same as that of the contact element 130A of Embodiment 2. However, the sixth contact element 230A in Embodiment 3 as shown in FIG. 11 is different from the fourth contact element 130A in that the contact points 236A and 237A are provided with the contact point operation levers 238A and 239A from the contact point 236A in the upper direction and from the contact point 237A in the lower direction, respectively. As a result, the contact points 236A and 237A can be opened in forced manner and thus the insertion of the card edge 100 does not require a pushing-in force.

Embodiment 3 is slightly different from Embodiments 1 and 2 in the structure of the front housing 221 because the sixth contact element 230A includes the contact point operation levers 238A and 239A.

At the corresponding positions of the upper and lower walls for providing the longitudinal rectangular tube-like space 223 of the front housing 221, the lever hole 223' communicated with the rectangular tube-like space 223 must be provided for every contact 230 provided by superposing the plurality of sixth and fifth contact elements 230A and 230B. Needless to say, in order to allow the contact point operation levers 238A and 239A of the plurality of contact elements 230A to be operated from outside, the contact point operation levers 238A and 239A as shown in FIGS. 12A to 12C have a length that they penetrate the respective lever holes 223' to protrude from the lever holes 223' to outside. In the case of Embodiment 3, in order to use the sixth contact element 230A to incorporate into the connector 210, the front housing 221 can be separated along the line X—X of FIG. 1.

The connector 210 according to Embodiment 3 is assembled as shown in FIG. 12A. More particularly, in the connector 210 according to Embodiment 3, the plurality of sixth and fifth contact elements 230A and 230B are firstly superposed alternately in the plate thickness direction to provide the contact 230. In this embodiment, the total of thirteen contact elements (containing six sixth contact elements 230A and seven contact elements 230B) are superposed to constitute the contact 230. Next, as in the case of Embodiment 1, the contact 230 is engaged in the engagement groove between the contact support sections (not shown) of the sleeve 240 and is fixed by a screw or the like to form the contact unit 250 (see FIG. 8). Thereafter, this contact unit 250 is installed in the space 227 of the rear housing 222 and the attachment means 261 (e.g., nut) is screwed into the connection terminal 241 of the contact unit 250, thereby fixing the contact unit 250 to the rear housing 222. Next, the upper and lower separated front housings 221 are attached so that the pair of arms 232 and 233 of the contact 230 are placed in the corresponding rectangular tube-like spaces 223 of the front housing 221 and so that the contact point operation levers 238A and 239A penetrate the cover hole 223'. Then, the attachment means (not shown) is used to fix the front housing 221 to the rear housing 222 for integration. In this way, the connector 210 for high current according to Embodiment 3 of the present invention is provided.

In order to insert the card edge 100 as a male side connector to the connector 210, an external pushing means is firstly used to simultaneously push the operation levers 238 and 239 of the contact 230 protruding from the connector housing 220 (more particularly, the contact point operation levers 238A and 239A of the plurality of contact element 230A) in the rearward direction (the direction shown by the arrow of FIG. 12B), as shown in FIG. 12B. As a result, the contact points 236A and 237A of the contact element 230A are opened in the upper and lower directions, respectively. Next, the card edge 100 is inserted to the opening space 224 until the card edge 100 is abutted with the inner wall to stop. When the pushing force of the operation levers 238 and 239 is canceled at this point of time, the elasticity of the contact points 236A and 237A allows the contact points 236A and 237A to return to the original position while the contact points 236A and 237A electrically contacting with the pad of the card edge 100.

As described above, the connector 210 according to Embodiment 3 does not require displacement of the contact points 236A and 237A by the card edge 100, when the card edge 100 as a male side connector is inserted. This totally eliminates the insertion resistance to further simplify the insertion of the card edge 100 (see FIG. 12B).

Embodiment 4

Figure 13:
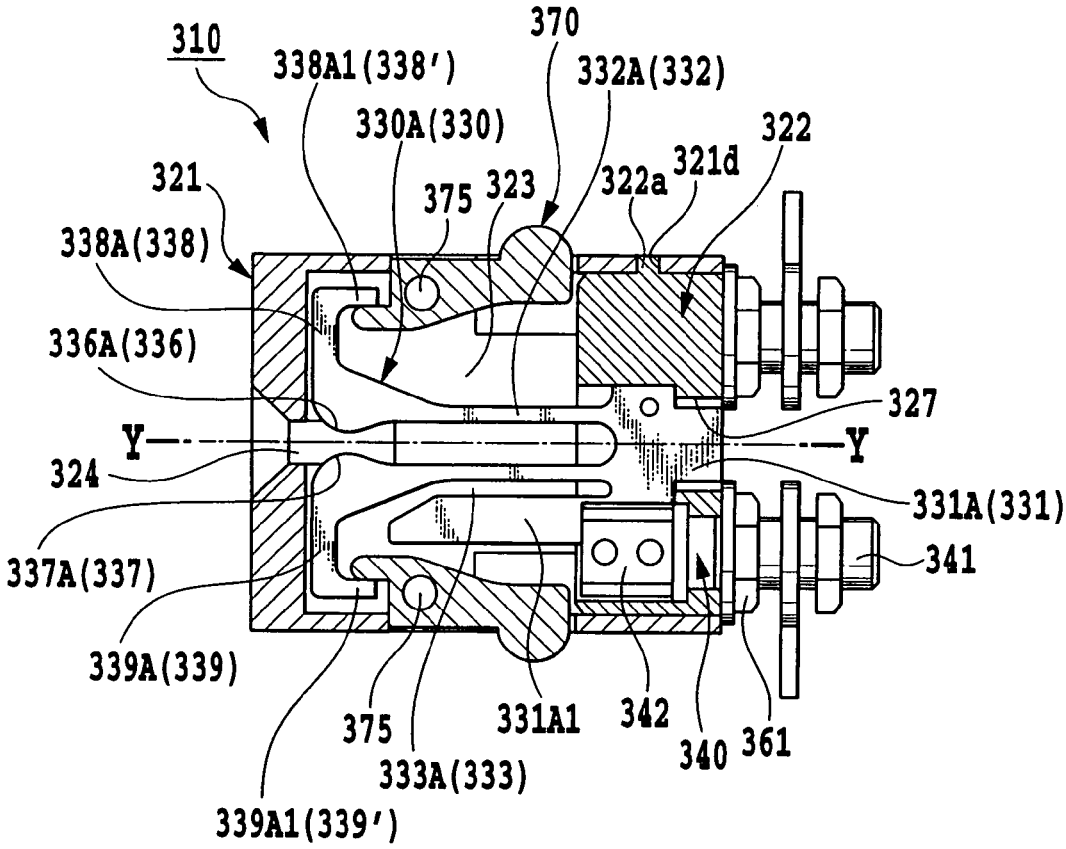
FIG. 13 is a schematic cross sectional view of the connector of Embodiment 4 according to the present invention as in FIG. 3A that is taken at the line XIIIA—XIIIA of the connector and showing when the male side connector is not inserted.
Figure 14:
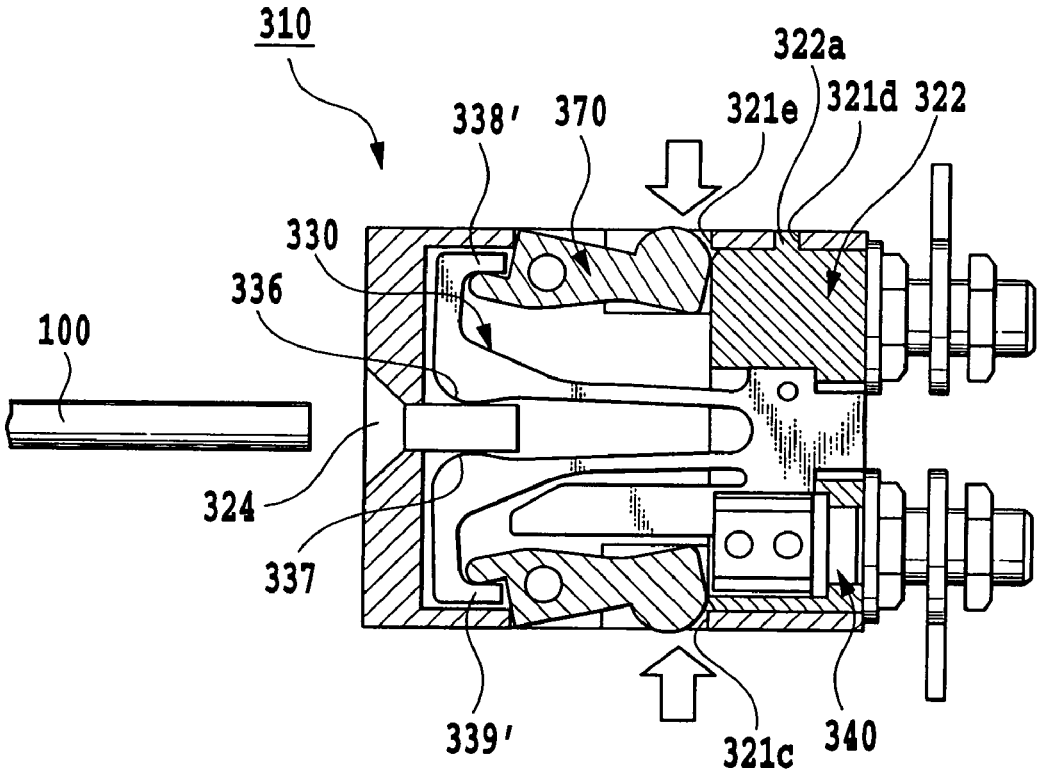
FIG. 14 is a cross-sectional view as in FIG. 13 that shows a process for inserting the male side connector.
Figure 15:
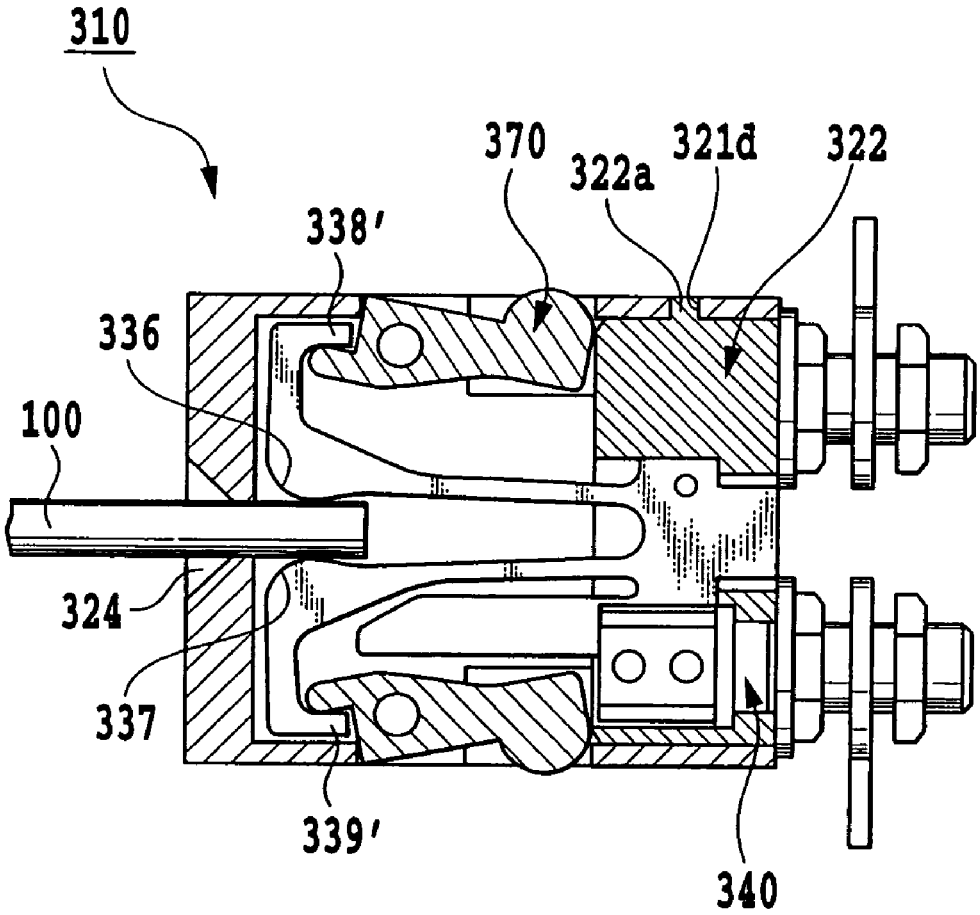
FIG. 15 is a cross-sectional view as in FIG. 13 that shows a status in which the male side connector is inserted.
Figure 16A:
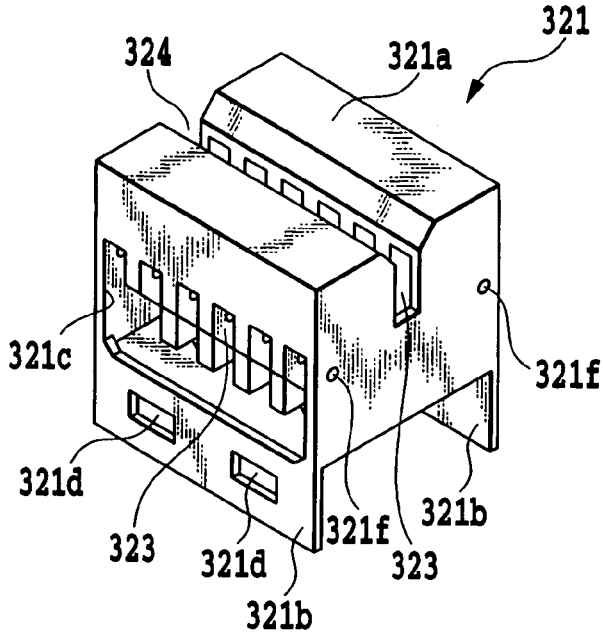
FIG. 16A is a schematic perspective view illustrating the front housing of Embodiment 4 of the present invention.
Figure 16B:
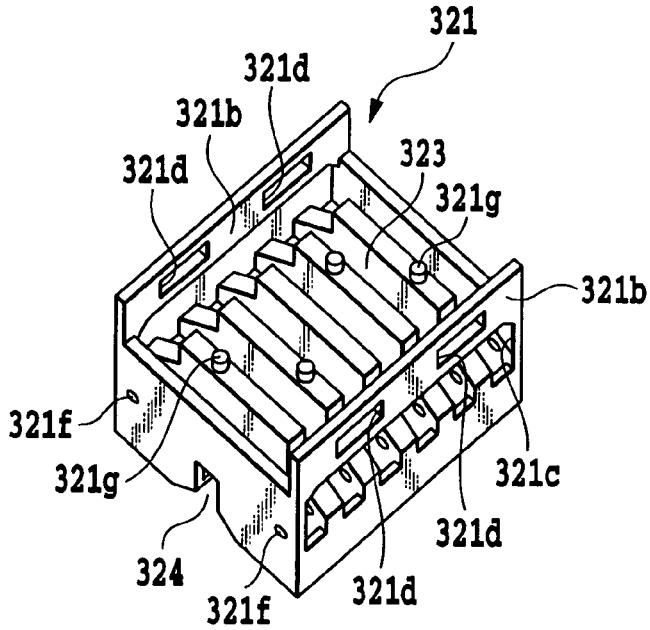
FIG. 16B is a schematic perspective view illustrating the front housing of FIG. 16A seen from the back side.
Figure 16C:
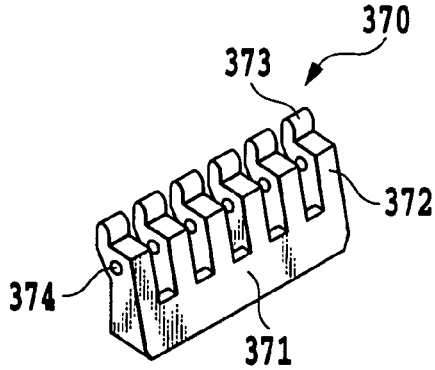
FIG. 16C is a perspective view of a latch that is attached to the front housing of FIG. 16A for opening or closing the contact.

Next, with reference to FIG. 13 to FIG. 16C, Embodiment 4 according to the present invention will be described. FIG. 13 is a schematic cross sectional view like FIG. 3A that is taken at the line XIIIA—XIIIA along the connector of FIG. 1 in which the male side connector is not inserted. FIG. 14 is a cross-sectional view like FIG. 13 that shows a process for inserting the male side connector. FIG. 15 is a cross-sectional view like FIG. 13 that shows when the male side connector is inserted. FIG. 16A is a schematic perspective view illustrating the front housing in Embodiment 4. FIG. 16B is a schematic perspective view illustrating the front housing of FIG. 16A seen from the back side. FIG. 16C is a perspective view of a latch in this embodiment for opening or closing the contact.

The connector according to Embodiment 4 is a connector as in Embodiment 3 that does not require, when the male side connector is inserted, a pushing force. The components in Embodiment 4 that correspond to those of Embodiment 1 are denoted such that the reference numerals showing such components of Embodiment 4 are added with 300.

First, the seventh contact element 330A in this embodiment will be described. As shown in FIG. 13, in the contact element 330A in Embodiment 4, the driving arms 338A and 339A are further extended in the first contact element 30A in Embodiment 1 from the respective tip ends 34A and 35A of the pair of the upper arm 32A and the lower arm 33A, so as to be orthogonal to the respective arms in the upper and lower directions, respectively.

Specifically, the seventh contact element 330A in this embodiment has the rectangular base end 331A and the pair of the upper arm 332A and the lower arm 333A extending from the side part of the upper part of the rectangular base end 331A so as to have a distance therebetween in the up-and-down direction. The rectangular base end 331A further has, at the lower part, an attachment hole (not shown). As shown in FIG. 13, the pair of the arms 332A and 333A are designed so as to be parallel to the center axis line Y—Y of the connector housing consisting of the front housing 321 and the rear housing 322 and so as to be symmetric to the axis line Y—Y. The pair of arms 332A and 333A are also provided so as to be displaced in the up-and-down direction in the drawing, specifically, so as to have elasticity. The contact points 336A and 337A are protruded respectively from the lower edge of the upper arm 332A and the upper edge of the lower arm 333A at positions that are rearward by a predetermined distance of the respective tip ends 334A and 335A of the upper arm 332A and the lower arm 333A. The contact points 336A and 337A are also protruded so that the projection tip ends of contact points 336A and 337A are opposed to each other. By this means, there are formed the contact points 336A and 337A f electrically contacting with the pad of the card edge 100. When being applied with no load, the projection tip ends of the contact points 336A and 337A are separated, as in the case of Embodiment 1, by a distance smaller than the thickness of the pad of the card edge 100. This allows the contact points 336A and 337A to contact with the pad of the card edge 100 with a desired contact pressure. In this embodiment, the driving arms 338A and 339A are provided in the direction orthogonal to the arms 332A and 333A, respectively as described above in the upper direction from the tip end 334A of the upper arm 332A and in the lower direction from the tip end 335A of the lower arm 333A. The tip end sections of the driving arms 338A and 339A have the engaging pieces 338A1 and 339A1 engaged with the engaging nail 373 of the latch 370 (which will be described later). The engaging pieces 338A1 and 339A1 are protruded from the tip end sections of the driving arms 338A and 339A in the rearward direction. These driving arms 338A and 339A and the engaging pieces 338A1 and 339A1 continuing from the driving arms 338A and 339A are provided so as to be symmetrical to the center axis line Y—Y of the housing 320, as in the case of the upper arm 332A and the lower arm 333A.

As shown in FIG. 13 to FIG. 15, the seventh contact element 330A further includes the radiation member 331A1 that protrudes from the lower part of the rectangular base end 331A to be substantially parallel to the lower arm 333A.

As in the above embodiment, the seventh contact element 330A in this embodiment is pressed out of a thin metal plate having the thickness of about 0.15 to 0.25 mm. In this embodiment, twelve contact elements 330A are superposed in the plate thickness direction to provide the contact 330.

In this embodiment, the connector 310 includes a pair of latches 370 as a driving means for forcedly opening the contact points 336 and 337 of the contact 330. As shown in FIG. 16C, the latch 370 includes the operating section 371 and a plurality of driving teeth 372 that have, at the tip end thereof, the engaging nail 373. A plurality of driving teeth 372 protrude from the operating section 371 in a comb teeth-like manner. A plurality of driving teeth 372 correspond to the pair of engaging sections 338' and 339' of the contact 330 which are the superposition of the engaging pieces 338A1 and 339A1 of the contact element 330A. A plurality of driving teeth 372 contacts with and is engaged with the engaging sections 338' and 339'. Through the entirety of these driving teeth 372, the plurality of driving teeth 372 have the through hole 374 through which the pin 375 as a rotation axis of the latch 370 (see FIG. 13 to FIG. 15) may penetrate. It is noted that in this embodiment, in order to rotate the latch 370 in an arbitrary direction (i.e., both clockwise and counterclockwise), the through hole 374 has a diameter that is slightly larger than that of the pin 375.

Due to the drive of contact 330 and the assembly of the connector 310, this embodiment is different from Embodiment 1 in the connector housing in which the contact 330 consisting of the seventh contact elements 330A is used.

As described above, the connector housing includes the front housing 321 and the rear housing 322.

The rear housing 322 has a structure that is almost the same as that of the rear housing 22 described in Embodiment 1. However, as shown in FIG. 13 to FIG. 15, the rear housing 322 in this embodiment is covered with the skirt section 321*b* of the front housing 321 (which will be described later). The rear housing 322 has, at the side wall, a plurality of assembling projections 322*a*. The assembling projections 322*a* are engaged to the corresponding plurality of assembling openings 321*d* provided at the skirt section 321*b* of the front housing 322, thereby forming the connector housing.

As in the case of Embodiment 1, the front housing 321 includes a plurality of rectangular tube-like spaces 323 for placing the contact 330, the main body 321*a* having the opening space 324 that is orthogonal to the rectangular tube-like space 323 and that is inserted with the card edge 100, and the skirt section 321*b* for covering the rear housing 322. Although in this embodiment the opening space 324 opens at the sides thereof as shown in FIGS. 16A and 16B, the opening section 324 also may be closed the sides by the side walls as in Embodiment 1 (see FIG. 1).

At the upper and lower parts of the main body 321*a* (see FIG. 13 to FIG. 15), the driving teeth 372 of the latch 370 are provided in the rectangular tube-like space 323 and the opening window 321*c* is provided such that the latch 370 can rotate with in the main body 321*a*. The skirt section 321*b* has a plurality of assembling openings 321*d* engaged with the assembling projections 322*a* of the rear housing 322, as described above. Although, in this embodiment, both side of the skirt section 321*b* opens as shown in FIGS. 16B and 16C, the skirt section 321*b* also may be closed so as to cover the both of the upper and lower sides of the housing 322 (specifically, entire outer periphery). The reference numeral

321*f* denotes an attachment hole to which the pin 375 as a rotation axis of the latch 370 is penetrated and fixed. The reference numeral 321*g* denotes a positioning pin used for the integration with the rear housing 322.

In the connector 310 in this embodiment, the contact 330 is firstly formed by superposing twelve seventh contact elements 330A. Next, the contact 330 is inserted to the engagement groove between the contact support sections of the sleeve 340 (one support section 342 of them is shown in FIG. 13 to FIG. 15) and is fixed by a screw or the like, thereby providing the contact unit. Thereafter, this contact unit is installed in the space 327 of the rear housing 322 and the attachment means 361 (e.g., nut) is screwed into the connection terminal 341, thereby fixing the contact unit to the rear housing 322. Next, the pair of arms 332 and 333 of the contact 330 are inserted to the corresponding rectangular tube-like space 323 of the front housing 321. Next, the assembling opening 321*d* provided at the skirt section 321*b* of the front housing 322 is engaged with the assembling projection 322*a* provided at the side wall of the rear housing 322, thereby integrating the front housing 321 with the rear housing 322. Next, from the opening window 321*c* provided at the main body 321*a* of the front housing 321, the latch 370 is inserted to the rectangular tube-like space 323 so that the plurality of engagements nail 363 of the latch 370 are engaged with the corresponding engaging sections 338' and 339' of the contact 330. Thereafter, the rotation axis pin 375 is inserted and fixed from the attachment hole 321*f* via the through hole 364 of the latch 370, thereby allowing the latch 370 to be attached to the front housing 322 in a rotatable manner. The operating section 371 of the latch 370 is preferably attached so as to be protruded from the upper and lower walls of the front housing 321, although not described above. For example, the operating section 371 also may be biased by a torsion spring (not shown). In this case, the torsion spring biases the latch 370 in a direction along which the latch 370 opens the contact 330. The biasing force of the torsion spring is provided to be lower than the spring force (elastic force) of the arms 332 and 333 of the contact 330. In this way, the connector 310 for high current according to Embodiment 4 of the present invention may be manufactured in an easy manner.

When the connector 310 is connected with the card edge 100 as a male side connector in the connector 310 in this embodiment, the external pushing means is used as shown in FIG. 14 to simultaneously push, in the inner direction (in the direction shown by the arrow of FIG. 14), the pair of operating sections 371 of the latch 370 protruding from the connector housing in the up-and-down direction. As a result, the contact points 336 and 337 of the contact 330 are opened in the up-and-down direction, respectively. Next, the card edge 100 is inserted to the opening space 324 until being abutted with the inner wall to stop. When the pushing force of the pair of operating section 371 is cancelled at this point of time, the contact points 336 and 337 are returned to the original positions by the elasticity of the arms 332 and 333 while electrically contacting with the pad of the card edge 100.

(Other embodiments)

Figure 17A:
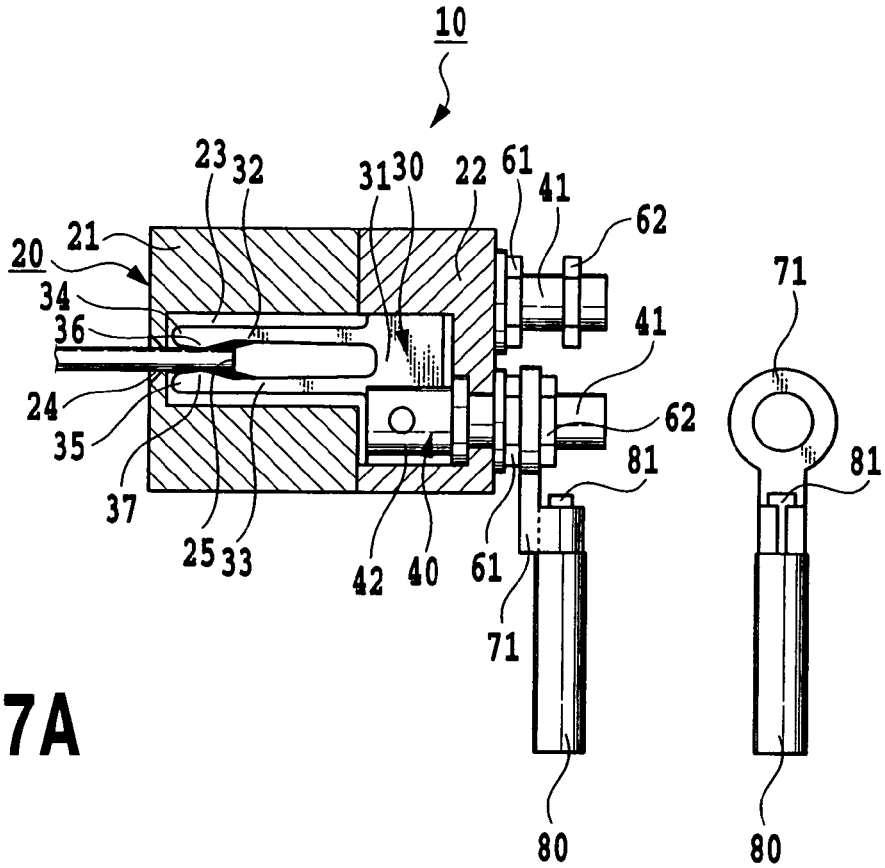
FIG. 17A shows the connection between a connection terminal of a contact unit constituting the connector according to the present invention and a cable via a cable terminal with tongue.
Figure 17B:
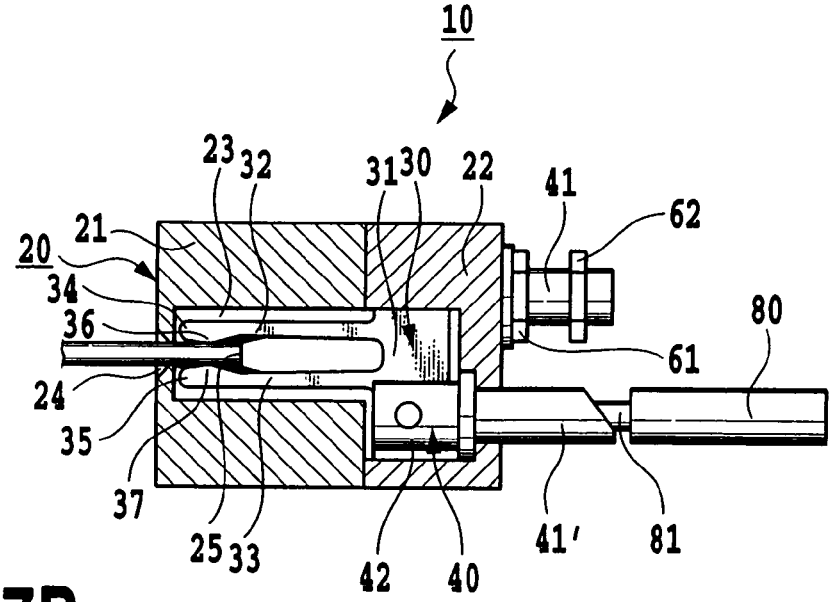
FIG. 17B shows the direct connection between a connection terminal of a contact unit constituting the connector according to the present invention and a cable by soldering.

The connection between the connection terminal of the contact unit and the cable may be provided via a cable terminal with tongue as shown in FIG. 17A or by a direct soldering as shown in FIG. 17B. In the drawings, the reference numeral 41 denotes a connection terminal screwed at the outer periphery of the contact unit, the reference numeral 41' denotes a cylindrical connection terminal having a hollow part to which the conductor 81 of cable 80 can be inserted, the reference numeral 71 denotes a tongue of a cable terminal, the reference numeral 80 denotes a cable, and the reference numeral 81 denotes a cable conductor.

The structure of the latch is also not limited to the integrated structure disclosed in Embodiment 4 (see FIG. 16C) and also may be provided by another member.

Figure 18A:
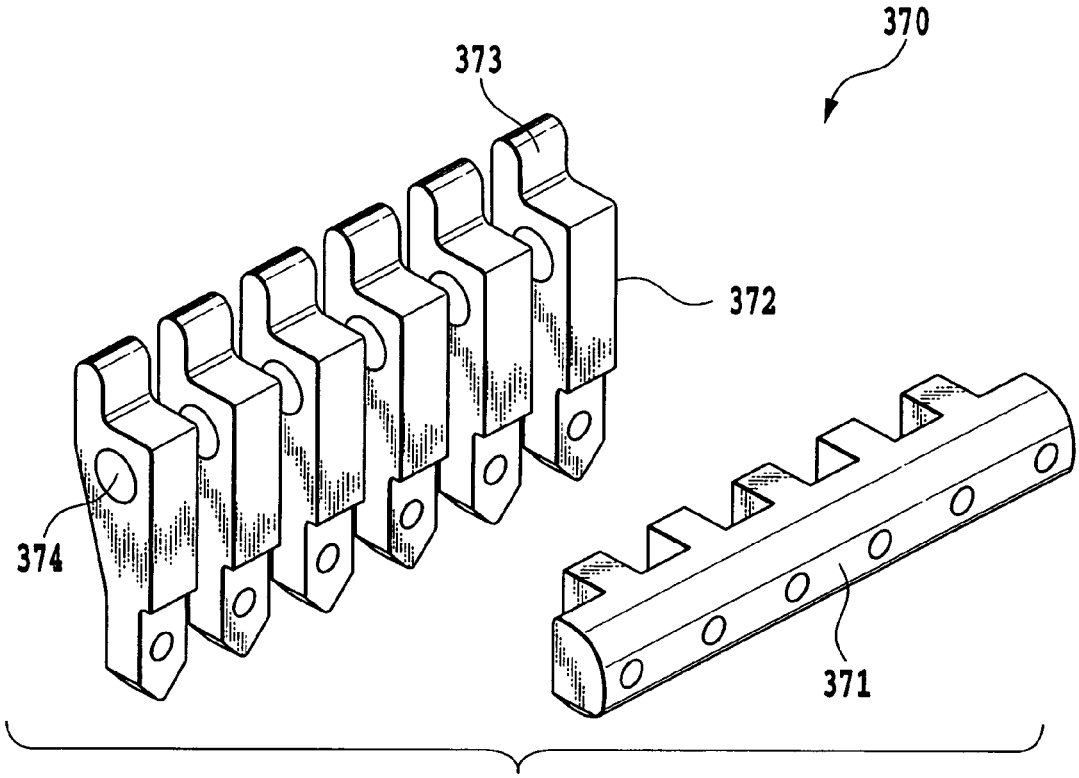
FIG. 18A is a perspective view illustrating another embodiment of the latch in Embodiment 4 of the present invention in which the latch is disassembled to show the respective members.
Figure 18B:
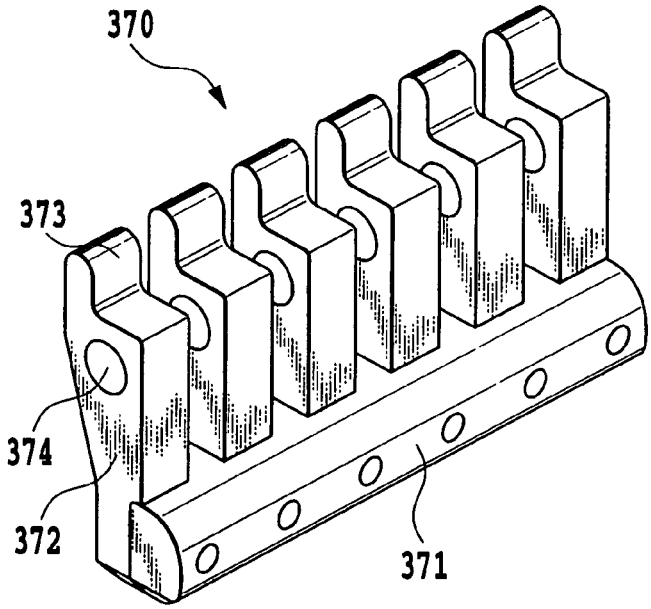
FIG. 18B is a perspective view of the assembly of the latch of FIG. 18A.
Figure 19:
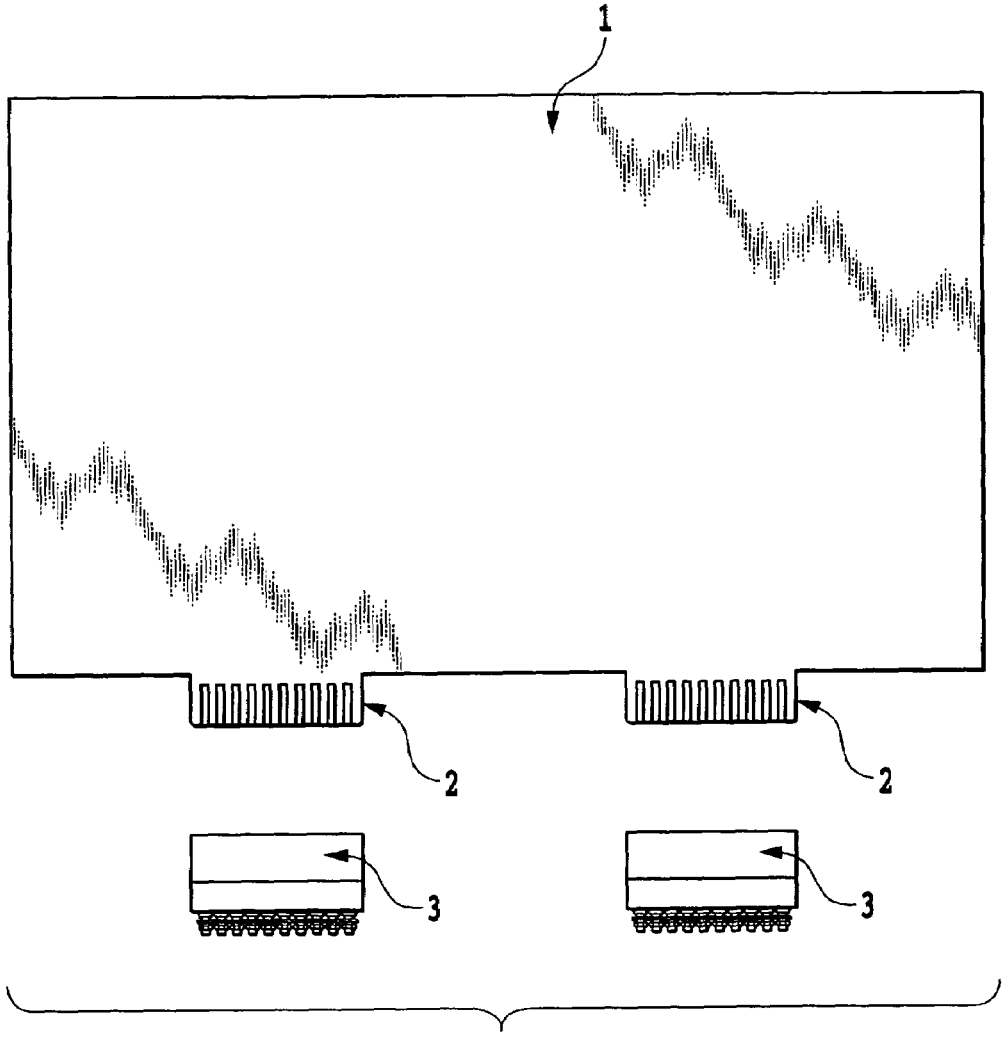
FIG. 19 shows an example of the use of the female side connector.

For example, as shown in FIGS. 18A and 18B, the driving teeth 372A including the engaging nail 373A is made of a high heat conduction material (e.g., aluminum) and the operating section 371A is made of an electrically insulating material (e.g., polyimide). The driving teeth 372A are attached in parallel in a comb teeth-like manner to the operating section 371A. The driving teeth 372A provided as another member, as described above, also may be fixed to the operating section 371A by a pressing-in or screw for example to provide the latch 370A. By providing the latch 370A as described above, the heat from the contact 330 can be radiated via the driving teeth 372A of the latch 370A and a high current can be flowed from the contact 330.

The male side connector that is a partner to the female side connector according to the present invention is also not limited to the card edge and also may be connected to an exclusive plate-like or pin-like male side connector.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A female side connector for high current comprising:

at least one contact unit including:

a contact provided by superposing a plurality of thin plate-like contact elements in a plate thickness direction, each contact element having a rectangular base end and a pair of elastically deformable arms (i) that extends from the rectangular base end parallel to each other and (ii) that has opposed contact points at the neighborhood of the tip end of each arm;

wherein the contact is provided such that the contact points of at least two adjacent contact elements are disposed at different distances measured from an arm tip end of one of the contact elements and the contact elements are superposed in the plate thickness direction.

2. A female side connector for high current as claimed in claim 1, wherein the at least two or more contact elements are arranged in parallel.

3. A female side connector for high current as claimed in claim 1, wherein the contact is formed such that neighboring contacts are symmetrically formed to a center axis of a connector housing.

4. A female side connector as claimed in claim 1, wherein the contact is provided such that the contact elements having respectively different distances from the arm tip end to the contact point are superposed to be adjacent to each other.

5. The female side connector as claimed in claim 1, further comprising:

a contact support section holding together the plurality of contact elements;

a connection terminal that is integrated with the contact support section to provide electrical connection to said contact; and an insulated housing.

6. A female side connector comprising:

a contact having a plurality of thin plate-like contact elements in a plate thickness direction, each contact element having a base end and a pair of elastically deformable arms that extend from the base end parallel to each other, each pair of elastically deformable arms having associated opposed contact points disposed at a predetermined distance from a tip end, opposite to the base end, of each arm;

wherein the contact is provided such that at least two or more contact elements, having the associated opposed contact points disposed at different predetermined distances measured from the associated tip end, are stacked side-by-side in the plate thickness direction.

7. A female side connector as claimed in claim 6, further comprising:

a contact support section configured to attach to the base end of the contact;

a connection terminal that is integrated with the contact support section and configured to be electrically connectable to an outside connection; and a connector housing configured to receive the contact support section.

* * * * *